US006572308B1

(12) United States Patent
Busto

(10) Patent No.: US 6,572,308 B1
(45) Date of Patent: Jun. 3, 2003

(54) WATER JET EARTH ANCHOR

(76) Inventor: Rodney Busto, 13385 Harold Ave., Spring Hill, FL (US) 34609

( * ) Notice: Subject to any disclaimer, the term of this patent is extended or adjusted under 35 U.S.C. 154(b) by 0 days.

(21) Appl. No.: 10/065,114

(22) Filed: Sep. 18, 2002

(51) Int. Cl.[7] ..... E02D 5/80
(52) U.S. Cl. ..... 405/259.1; 52/163; 52/166
(58) Field of Search ..... 405/259.1, 258.1, 405/303; 52/155, 162, 163, 166

(56) References Cited

U.S. PATENT DOCUMENTS 4,023,314 A 5/1977 Tanner
4,044,513 A 8/1977 Deike
4,688,360 A * 8/1987 Luong et al. ..... 52/166
4,727,693 A * 3/1988 Rockenfeller et al. ..... 52/163
4,738,063 A * 4/1988 Alsop ..... 52/163
5,175,966 A * 1/1993 Remke et al. ..... 405/259.1
5,625,984 A * 5/1997 Chapman et al. ..... 405/259.1
5,833,400 A 11/1998 Wamsher
5,881,506 A * 3/1999 Chapman et al. ..... 405/259.1

* cited by examiner

*Primary Examiner*—Heather Shackelford
*Assistant Examiner*—Frederick L. Lagman
(74) *Attorney, Agent, or Firm*—Ronald E. Smith; Smith & Hopen, P.A.

(57) ABSTRACT

An earth anchor has a thin, elongate base to facilitate its introduction into the earth. Strengthening ribs extend along its longitudinal extent on both sides of the elongate base. The distal end of an anchor strap is secured to the elongate base and a proximal end of the anchor strap remains above the surface of the earth so that it can be pulled upon when the elongate base has reached a desired depth. In a preferred embodiment, a water jet positioned at the leading end of the elongate base bores a hole into which the earth anchor is inserted. Pulling on the anchor strap causes the elongate base to rotate about its trailing end until it assumes a horizontal, deployed position. Items secured to the proximal end of the anchor strap are held firmly to the ground because the deployed earth anchor offers substantial resistance to displacement.

21 Claims, 8 Drawing Sheets

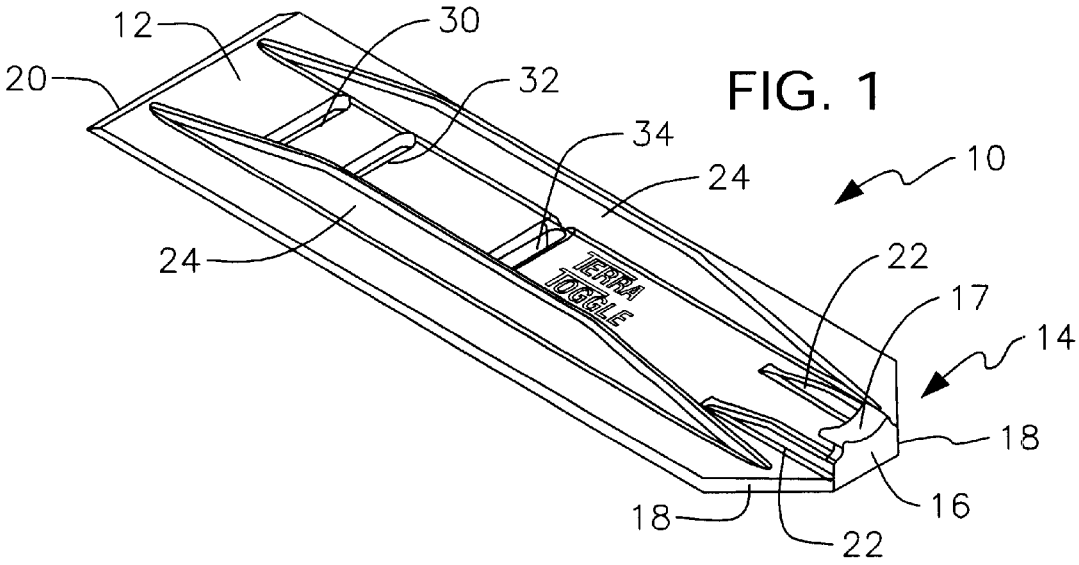
FIG. 1
FIG. 2
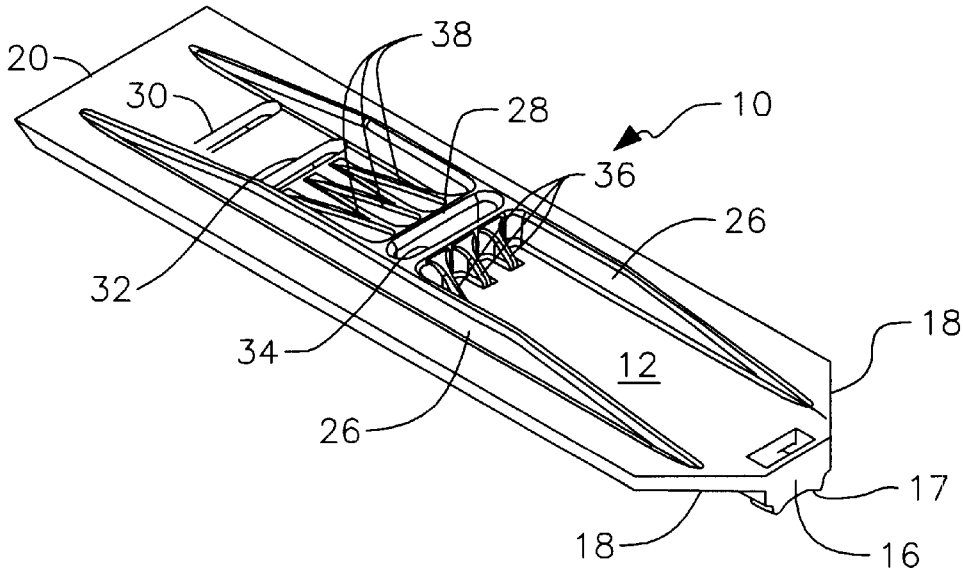

WATER JET EARTH ANCHOR

BACKGROUND OF INVENTION

1. Field of the Invention

This invention relates, generally, to devices that hold down movable objects so that they are not displaced by windstorms and the like. More particularly, it relates to an earth anchor apparatus having a water jet that facilitates its introduction into the ground.

2. Description of the Prior Art

U.S. Pat. No. 4,044,513 to Deike discloses an earth anchor that is driven into the earth by a hollow ram that enters the trailing end of the earth anchor. A concrete slurry is pumped through the hollow ram as it is retracted and a plug presses the concrete into crevices and pores surrounding the hole.

A mobile home anchor is disclosed in U.S. Pat. No. 4,023,314 to Tanner. Water is introduced into the earth through a hollow anchor post having a pair of diametrically opposed arms that are folded back during insertion of the apparatus into the earth. The arms are deployed when the anchor reaches its desired depth.

U.S. Pat. No. 5,833,400 to Wamsher is introduced into a borehole while in a vertical position. It burrows into the earth until the anchor is lodged in a position that is normal to the borehole.

The known earth anchors are characterized by relatively complex structures that include moving parts. Such earth anchors are expensive to manufacture. Some of them are also unreliable because their structural complexity can cause deployment failures or deployments that are less than optimal.

What is needed, then, is a reliable earth anchor having a simple structure, no moving parts, and a low price.

However, in view of the prior art considered as a whole at the time the present invention was made, it was not obvious to those of ordinary skill how the needed earth anchor could be provided.

SUMMARY OF INVENTION

The earth anchor of this invention performs the function of holding various items to the surface of the earth so that the wind or other externally applied force cannot displace said items.

The structure of the novel earth anchor includes a thin, elongate base having a longitudinal axis of symmetry, a transversely disposed leading end and a transversely disposed trailing end. A nozzle attachment means is positioned at the leading end of the elongate base and is disposed normal to a plane of said base.

The base may be flat or it may have a slight convexity or warp formed therein as a result of the molding process used to manufacture it. Whether perfectly flat or slightly warped, the base presents a thin profile that eases its entry into the earth.

The distal end of an elongate anchor means of flexible construction is secured to the elongate base. The elongate anchor means may be provided in the form of an anchor strap, rope, wire, cable, or the like. The proximal end of the elongate anchor means is positioned above the surface of the earth when the distal end thereof is positioned at a preselected depth below the surface of the earth so that the proximal end can be pulled upon to set the novel earth anchor against retraction.

The nozzle attachment means is adapted to releasably engage a leading end of an elongate jet pipe means. The elongate jet pipe means is positioned substantially parallel to the elongate base when the leading end of the elongate jet pipe means is releasably engaged to the nozzle attachment means. The elongate base and jet pipe means together form a pipe anchor assembly as a whole.

Means are provided for introducing a liquid fluid under pressure into a trailing end of the jet pipe means so that the elongate base is inserted into the earth by first positioning the elongate base in substantially normal relation to the surface of the earth with its leading edge in abutting relation to the surface. Liquid fluid under pressure is then introduced into the trailing end of the jet pipe means and pressure is applied to the trailing end of the jet pipe means while the liquid fluid is flowing from the leading end of the jet pipe means. The liquid fluid flowing from the leading end of the jet pipe means forms a borehole in the earth. The jet pipe means is withdrawn when the earth anchor reaches a preselected depth. The proximal end of the anchor strap is then pulled upon to set the earth anchor at said depth. More particularly, pulling on the elongate anchor means causes the earth anchor to rotate about its trailing end until it deploys into a substantially horizontal position where it is substantially perpendicular to the borehole.

The earth anchor presents substantial resistance to displacement from the preselected depth when so deployed so that preselected items may be tied to the proximal end of the elongate anchor means to secure the preselected items to the surface of the earth.

The preferred method for installing an earth anchor at a preselected depth below the surface of the earth includes the step of providing a thin, elongate base having a longitudinal axis of symmetry, a transversely disposed leading end and a transversely disposed trailing end. Further steps include securing the distal end of an elongate anchor means of flexible construction to the elongate base and positioning a nozzle attachment means at the leading end of the elongate base. The steps further include disposing the nozzle attachment means normal to a plane of the elongate base, adapting the nozzle attachment means to releasably engage a leading end of an elongate jet pipe means, positioning the elongate jet pipe means substantially parallel to the elongate base when the leading end of the elongate jet pipe means is releasably engaged to the nozzle attachment means, dimensioning the elongate anchor means so that a proximal end thereof may be pulled upon when its distal end is positioned at a preselected depth below the surface of the earth, injecting a liquid fluid under pressure into a trailing end of said jet pipe means, inserting the pipe anchor assembly as a whole into the earth by positioning said elongate base in substantially normal relation to the surface of the earth with its leading edge in abutting relation to said surface, by introducing liquid fluid under pressure into the trailing end of the jet pipe means, applying pressure to the trailing end of the jet pipe means while the liquid fluid is flowing from the leading end of the jet pipe means, retracting the jet pipe means when the elongate base reaches its preselected depth, and pulling upon said proximal end of the anchor strap to cause the elongate base to pivot about its trailing end until it obtains a position substantially perpendicular to the borehole.

In this way, the earth anchor presents substantial resistance to displacement from the preselected depth when so deployed so that preselected items may be tied to the proximal end of the elongate anchor means to secure said preselected items to the surface of the earth.

BRIEF DESCRIPTION OF DRAWINGS

For a fuller understanding of the nature and objects of the invention, reference should be made to the following detailed description, taken in connection with the accompanying drawings, in which:

FIG. 1 is a top perspective view of the novel earth anchor;

FIG. 2 is a bottom perspective view thereof;

DETAILED DESCRIPTION

Figure 3:
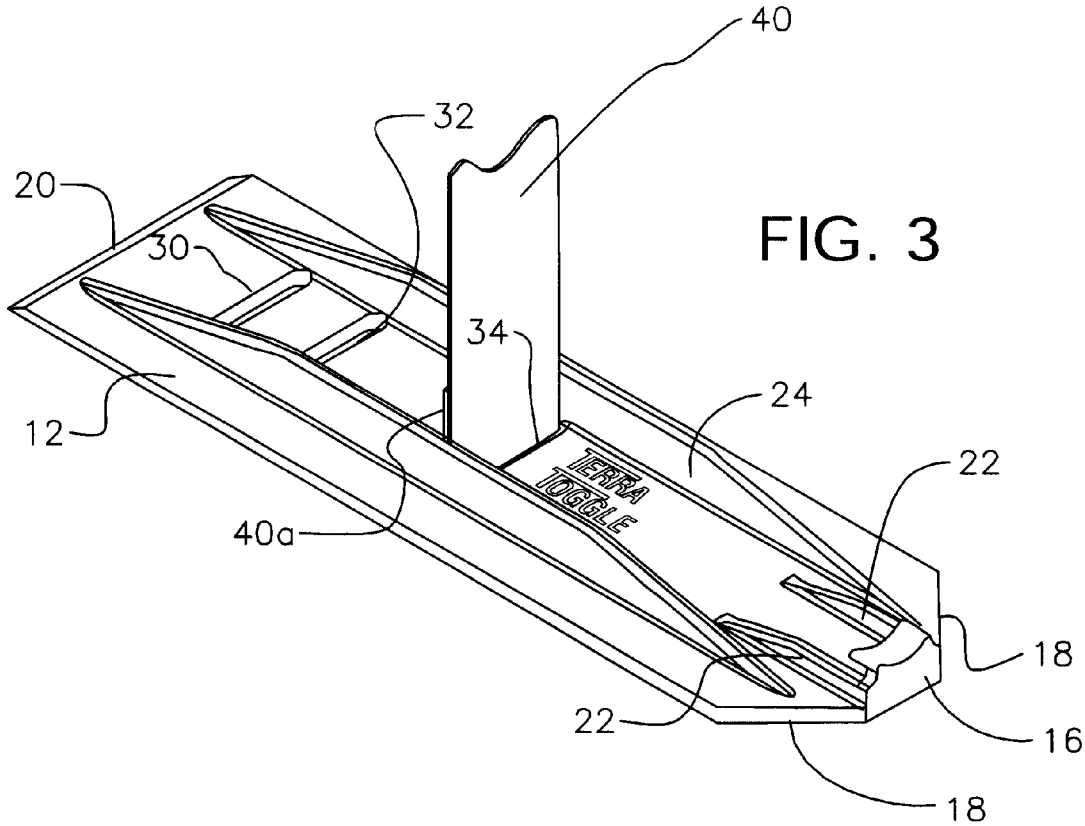
FIG. 3 is a top perspective view thereof when an anchor strap is attached thereto.

Referring now to FIG. 1, it will there be seen that the reference numeral 10 denotes an illustrative embodiment of the present invention as a whole.

The elongate base 10 of the novel earth anchor performs the function of anchoring a rope, wire, cable, strap, or the like, into the earth. The elongate base works in much the same way as a toggle bolt because the elongate base has a narrow profile when driven into the earth. After it has been driven into the earth, it is rotated into a horizontal position so that retraction of the elongate base from the earth is substantially impeded. The pull-out resistance enables items to be tied down by rope, wire, straps, and the like.

There are two methods for installing the earth anchor. An elongate anchor means of flexible construction, preferably in the form of an anchor strap, is attached to the elongate base as the first step in both methods.

In the first method, a borehole is drilled into the soil to a depth of eighteen to thirty six inches (18"–36"), preferably with an electric drill and auger bit. The elongate base is then inserted into the borehole to the desired depth, depending upon the application, and the anchor strap is pulled. Pulling on the anchor strap causes the elongate base to pivot about its trailing end until it attains a horizontal position , i.e., a position that is substantially perpendicular to the borehole. This position is the deployed position of the elongate base and further tension applied to the anchor strap will not displace the elongate base from its deployed position.

In the second method, water under pressure is introduced into the trailing end of an elongate jet pipe by means of a common garden hose and the leading end of the jet pipe is attached to the leading end of the elongate base and introduced into the soil. More particularly, the leading end of the jet pipe abuts a nozzle attachment at the leading end of the elongate base. The assembly as a whole thus forms a pipe anchor assembly. The trailing end of the jet pipe is pressed into the ground as the water bores the hole, and the anchor strap is simultaneously pulled upon so ensure that the pipe anchor assembly remains in its functional position. The jet pipe is then removed from the elongate base, leaving the elongate base at a preselected depth below the surface of the earth. The anchor strap is then pulled upwardly and the elongate base pivots about its trailing edge until it assumes a position substantially perpendicular to the borehole and it is then ready for use.

The elongate base may be manufactured by plastic injection molding, metal stamping, or any other suitable manufacturing method. It is preferably formed of tough, high-grade plastic to ensure reliable anchor strength. The design takes advantage of the economy of high volume plastic manufacturing to realize significant cost savings. The unique design also provides quick, labor-saving installation. The elongate base may theoretically be flat but the manufacturing process typically introduces a convexity or warp thereinto which advantageously increases the strength thereof.

Referring now to FIG. 1, it will there be seen that a first embodiment of the invention is denoted as a whole by the reference numeral 10.

Earth anchor 10 has an elongate, slender profile to facilitate its entry into the earth. More particularly, it includes a thin, elongate base 12, also known as a horizontal stabilizing surface plane because it is substantially horizontally disposed when the earth anchor is properly installed. Its surface area provides resistance to pull out.

The leading end of flat base 12 is denoted 14 as a whole and includes a hollow nozzle attachment 16 and a pair of swept back leading walls, collectively denoted 18, and also called an entry chamfer means that facilitates entry of earth anchor 10 into the soil with minimal resistance.

Concave surface 17 of nozzle attachment 16 matches the contour of a jet pipe when the above-described water jetting method of installation is used.

The trailing end of elongate base 12 is denoted 20. Note that a chamfer is formed in trailing end 20, thereby forming a wedge-shaped trailing end or wedge chamfer 20. Wedge chamfer 20 digs into the borehole when the anchor strap is pulled, thereby causing earth anchor 10 to rotate into its deployed position.

Reference numeral 22 collectively indicates a first pair of transversely spaced apart, upstanding stiffening ribs of truncate extent that have their respective leading ends formed integrally with nozzle attachment 16 and which extend in parallel relation to one another and to a longitudinal axis of symmetry of elongate base 12.

A second pair of transversely spaced apart, upstanding stiffening ribs, collectively denoted 24, extend from leading end 14 to trailing end 20 of elongate base 12. Each rib 24 of said pair of ribs has a leading end, a medial part, and a trailing end. The leading end is beveled to facilitate entry into the earth of earth anchor, 10.

As depicted in FIG. 2, a third pair of transversely spaced apart, upstanding stiffening ribs, collectively denoted 26, extend from leading end 14 to trailing end 20 of second side 24 of elongate base 12. Ribs 26 are interconnected to one another, about mid-length thereof, by a transversely disposed support brace 28.

Three transversely disposed, longitudinally spaced apart slots, 30, 32, and 34 are formed in elongate base 12 and extend completely therethrough as also understood by comparing FIGS. 1 and 2. Slot 34 is also formed in support brace 28.

A first plurality of transversely spaced apart, truncate stiffening ribs, collectively denoted 36, provide a ramp-like support for support brace 28 on a leading side thereof.

A second plurality of transversely spaced apart stiffening ribs, collectively denoted 38, have a greater longitudinal extent than stiffening ribs 36, and provide a ramp-like support for support brace 28 on a trailing side thereof.

An elongate anchoring means of flexible construction in the form of anchor strap 40 is depicted in FIG. 3 disposed normal to the plane of elongate base 12. As will become clear as this description proceeds, said anchor strap is substantially parallel to flat base 12 during the insertion of earth anchor 10 into the ground.

Figure 4A:
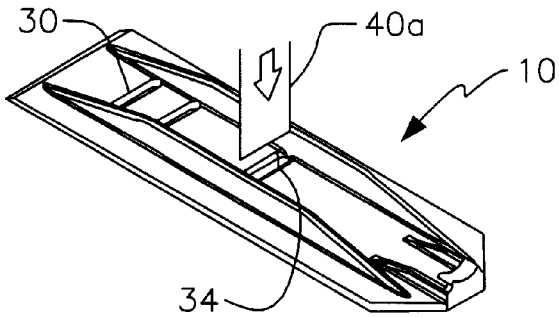
FIG. 4A is the first perspective view in a four view animation that depicts a preferred path of travel of the anchor strap that connects the anchor strap to the earth anchor.
Figure 4B:
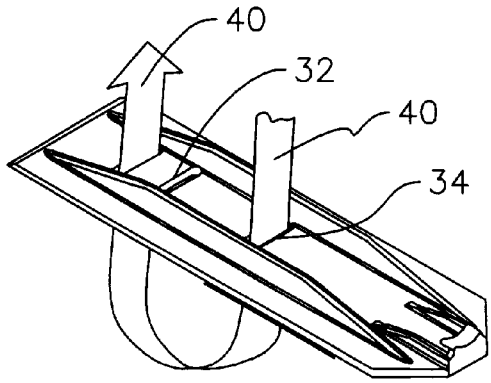
FIG. 4B is the second view of said animation.
Figure 4C:
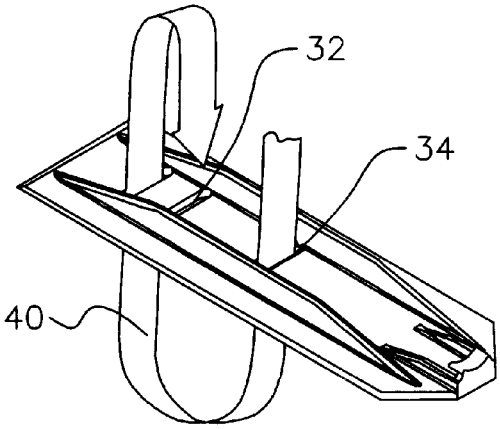
FIG. 4C is the third view of said animation.
Figure 4D:
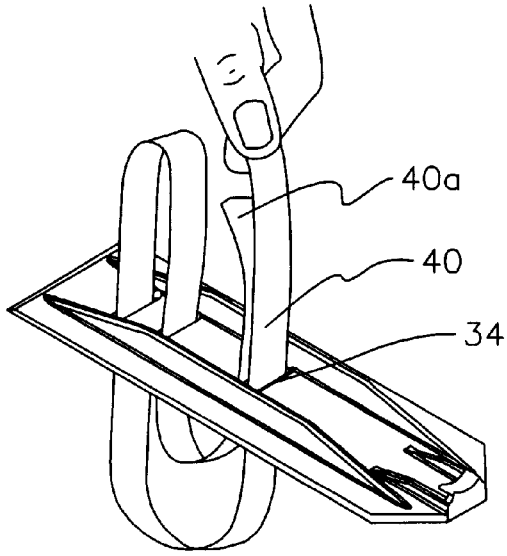
FIG. 4D is the fourth view of said animation.

The preferred method for attaching anchor strap 40 to elongate base 12 is depicted in FIGS. 4A–D. As indicated in FIG. 4A, anchor strap 40 has a free end 40*a* that is first inserted from a first side of elongate base 12 through slot 34 formed in support brace 28 so that the free end is then on a second side of said elongate base 12. Free end 40*a* is then extended through slot 30 as depicted in FIG. 4B so that said free end is again on said first side. Free end 40*a* is then extended through slot 32 as depicted in FIG. 4C so that it is again on the second side of elongate base 12. Finally, free end 40*a* is extended through slot 34 as depicted in FIG. 4D and said free end 40*a* is secured to anchor strap 40 on the first side of elongate base 12 so that anchor strap 40 has the configuration as depicted in FIG. 3. The proximal end of anchor strap 40 is secured to an item supported by the surface of the earth.

Anchor strap 40 could also be provided in the form of a rope, wire, cable, or the like.

Figure 5:
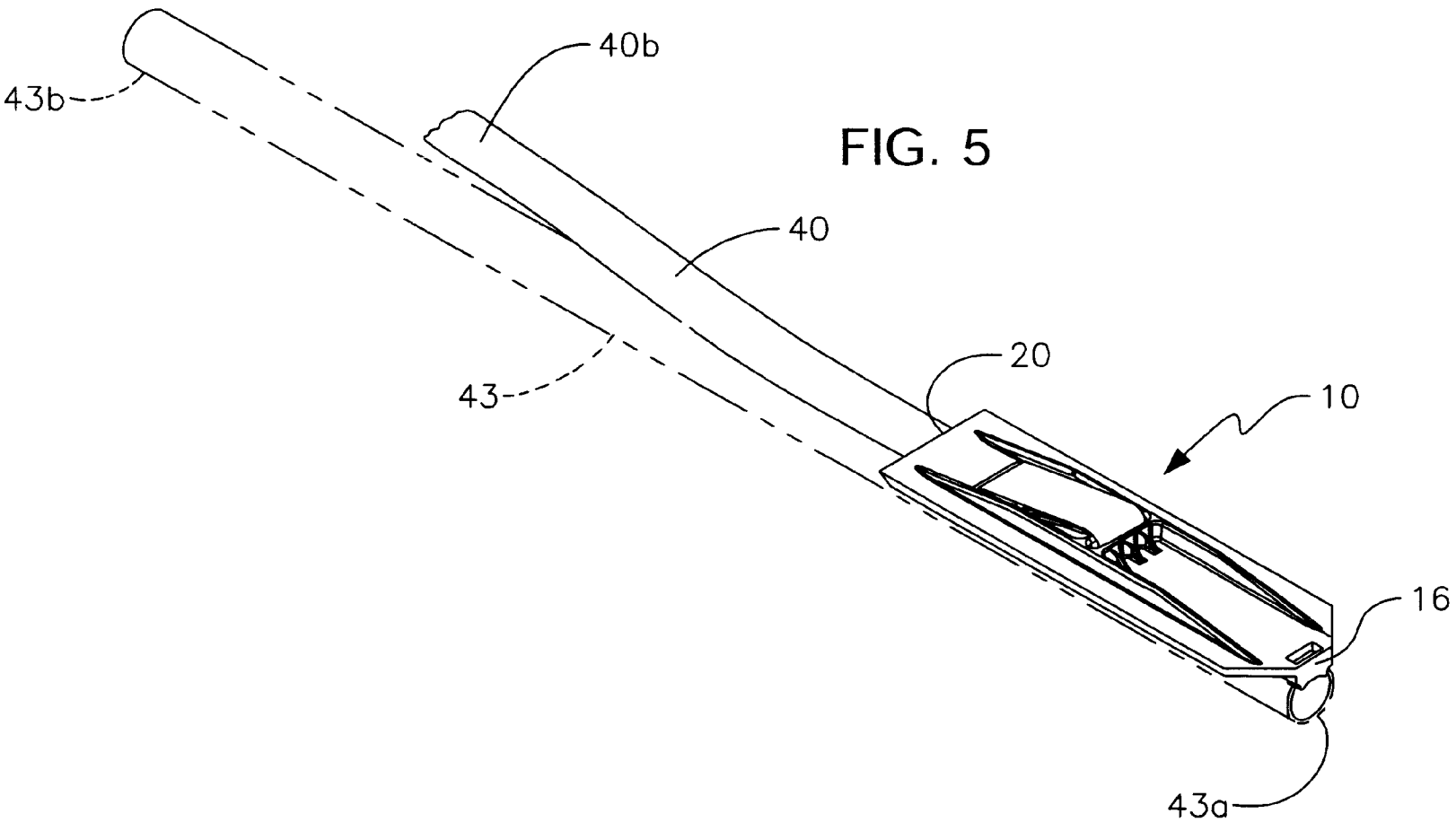
FIG. 5 is a perspective view like that of FIG. 2 and including a jet pipe in phantom lines.

FIG. 5 depicts an elongate jet pipe means in the form of a jet pipe 43 having its leading end 43*a* disposed in abutting engagement with nozzle attachment 16. This arrangement of parts forms the above-mentioned pipe anchor assembly. Water under pressure is introduced into jet pipe 43 at its trailing end 43*b* to insert elongate base 12 into the earth. As mentioned earlier, anchor strap 40 is positioned substantially parallel to elongate base 12 during the insertion procedure, it being understood that jet pipe 43 overlies said anchor strap during the insertion procedure. Again, the user presses down on jet pipe means.43 while pulling up on anchor strap 40 during the insertion procedure to ensure that the parts of the pipe anchor assembly remain in the respective functional positions during such procedure.

When the pipe anchor assembly reaches a preselected depth, anchor strap 40 is released and jet pipe 43 is withdrawn from the earth. Proximal end 40*b* of anchor strap 40 is then pulled upon again so that trailing edge 20 of elongate base 12 engages the borehole and earth anchor 10 pivots about said trailing edge 20 until said earth anchor is substantially perpendicular to the borehole. Proximal end 40*b* is then tied to an item to be anchored to the earth.

Figure 6:
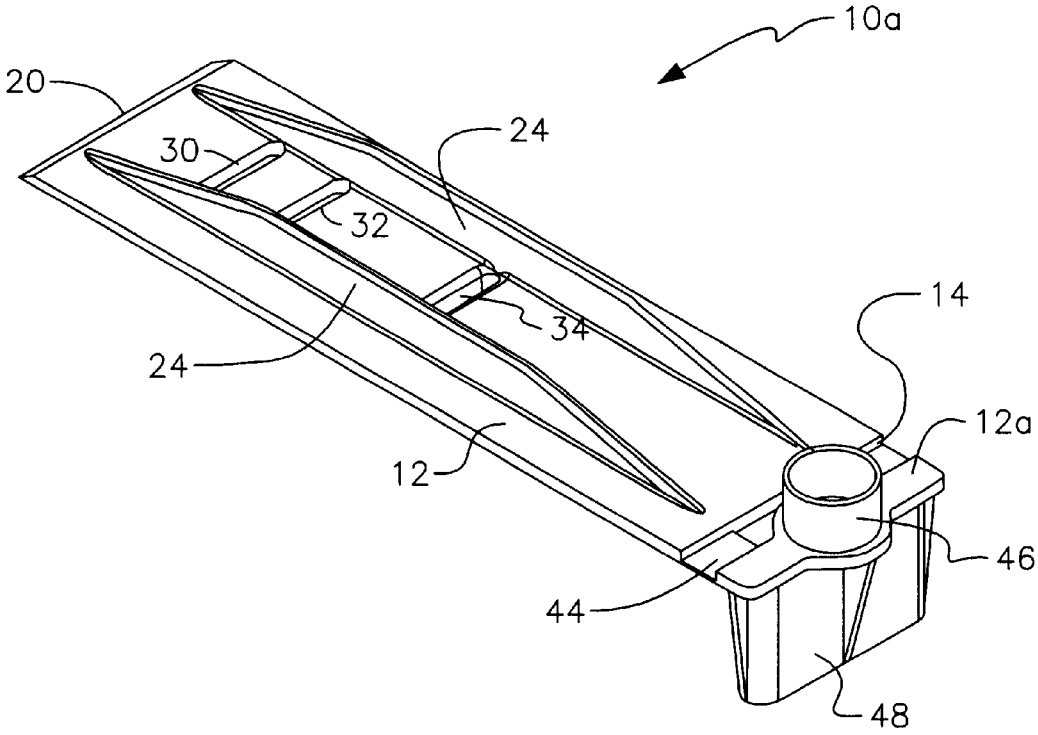
FIG. 6 is a top perspective view of a second embodiment.
Figure 7:
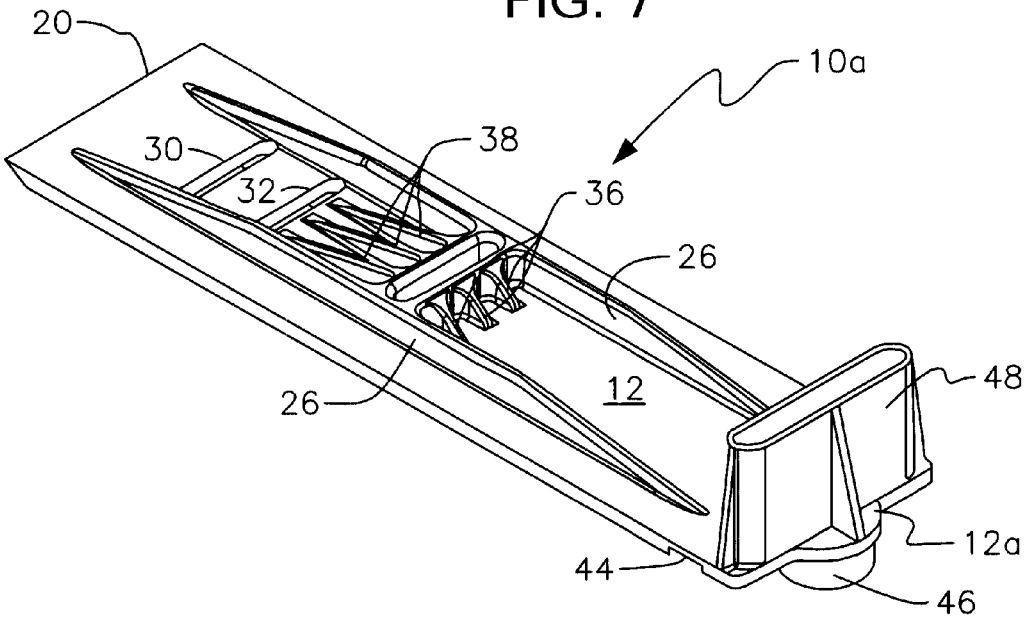
FIG. 7 is a bottom perspective view of the second embodiment.
Figure 8:
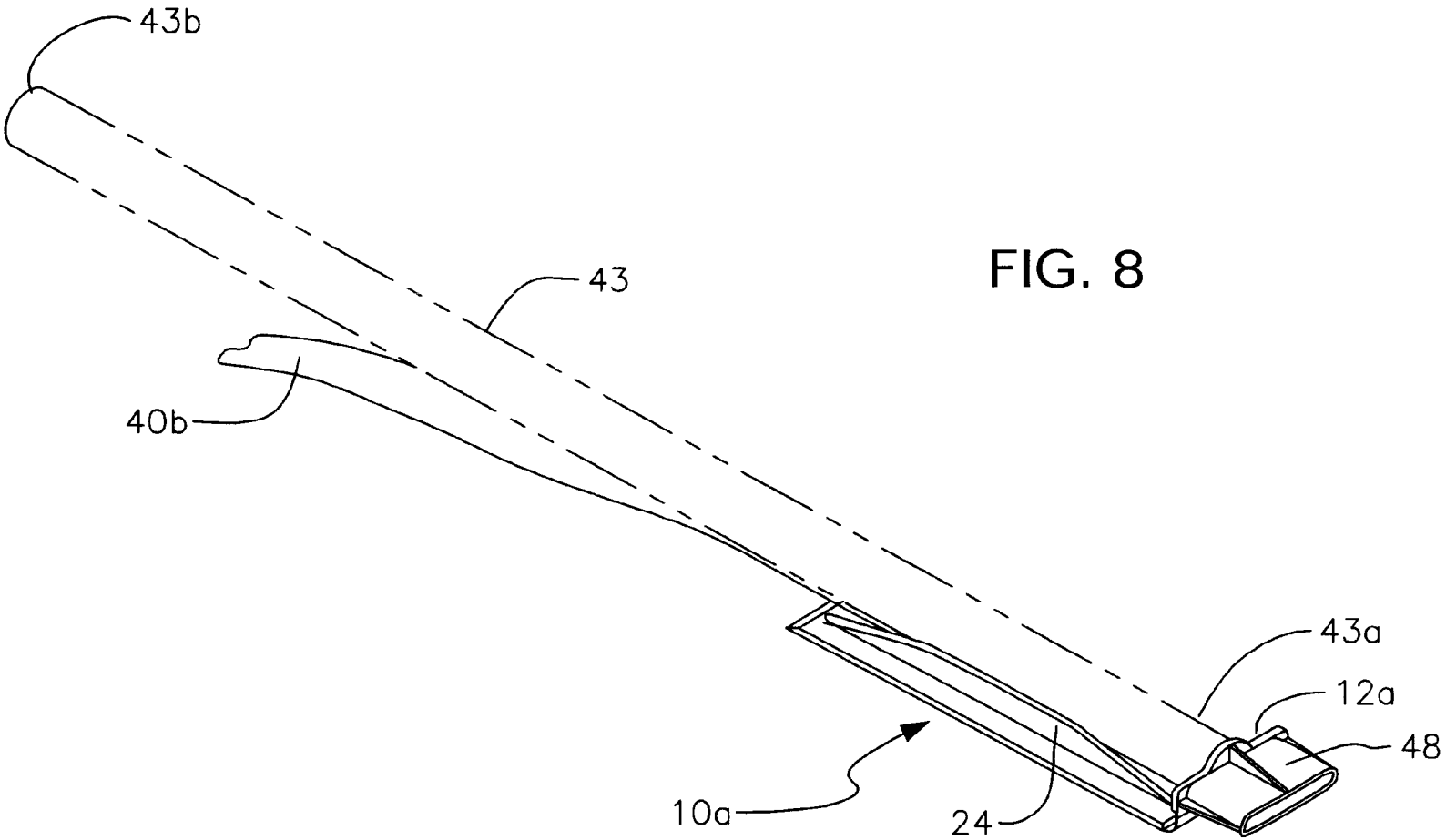
FIG. 8 is a perspective view like that of FIG. 6 and including a jet pipe in phantom lines.

In a second embodiment, depicted in FIGS. 6, 7, and 8, a living hinge 44, or other suitable hinge means, is formed integrally with leading end 14 of elongate base 12. Base extension 12*a* is formed integrally with the leading end of hinge 44 and has a thickness substantially equal to the thickness of elongate base 12. Base extension 12*a* is substantially co-planar with elongate base 12 when living hinge 44 is in repose. Its repose position is depicted in FIGS. 6 and 7.

Jet pipe connector 46 is secured to or formed integrally with a first side of base extension 12*a* and projects therefrom in normal relation thereto as depicted. A narrow nozzle means 48 is secured to or integrally formed with a second side of base extension 12*a* and projects therefrom in normal relation thereto as depicted.

Accordingly, to use this embodiment of the novel earth anchor, base extension 12*a* is rotated from its FIGS. 6 and 7 position to its FIG. 8 position, it being understood that living hinge 44 enables such rotation. Leading end 43*a* of jet pipe 43 is secured by suitable means to jet pipe connector 46 as depicted in FIG. 8 and water under pressure is introduced into trailing end 43*b* of said jet pipe. The connection between leading end 43*a* of the jet pipe and connector 46 may be by screw threads, by press fit, or any other releasable means.

Narrow nozzle 48 is in open fluid communication with said jet pipe, it being understood that base extension 12*a* is centrally apertured. In this way, water under pressure flowing through narrow nozzle 48 cuts a narrow path into the soil as jet pipe 43 is pushed downwardly. When the desired depth is reached, the jet pipe is released from pipe connector 46 and said jet pipe is retrieved. Anchor strap 40 is then pulled upon to set earth anchor 10 as described in connection with the first embodiment.

Figure 9:
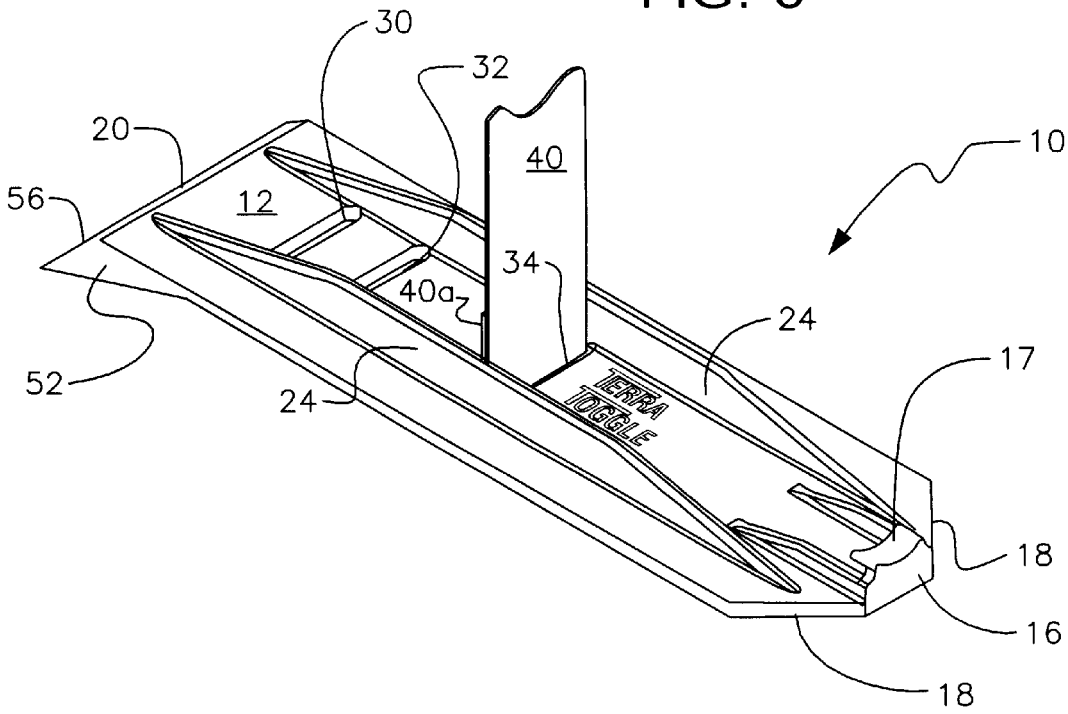
FIG. 9 is a top perspective view of a second embodiment of the elongate base.
Figure 10:
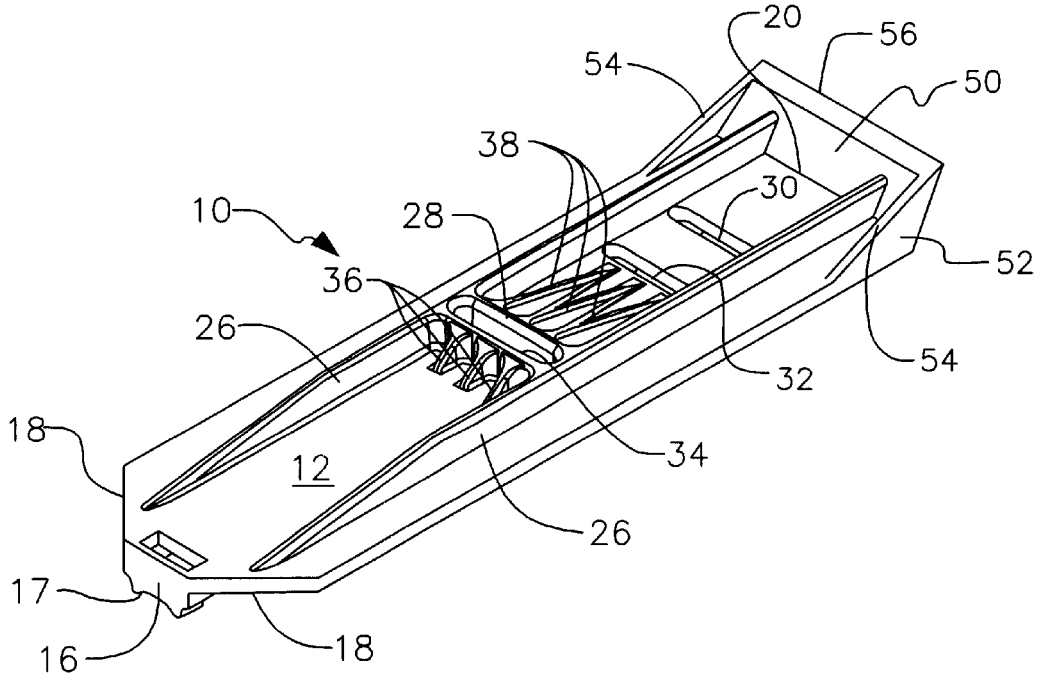
FIG. 10 is a bottom perspective view of said elongate base having an anchor strap attached thereto.
Figures 11, 12:
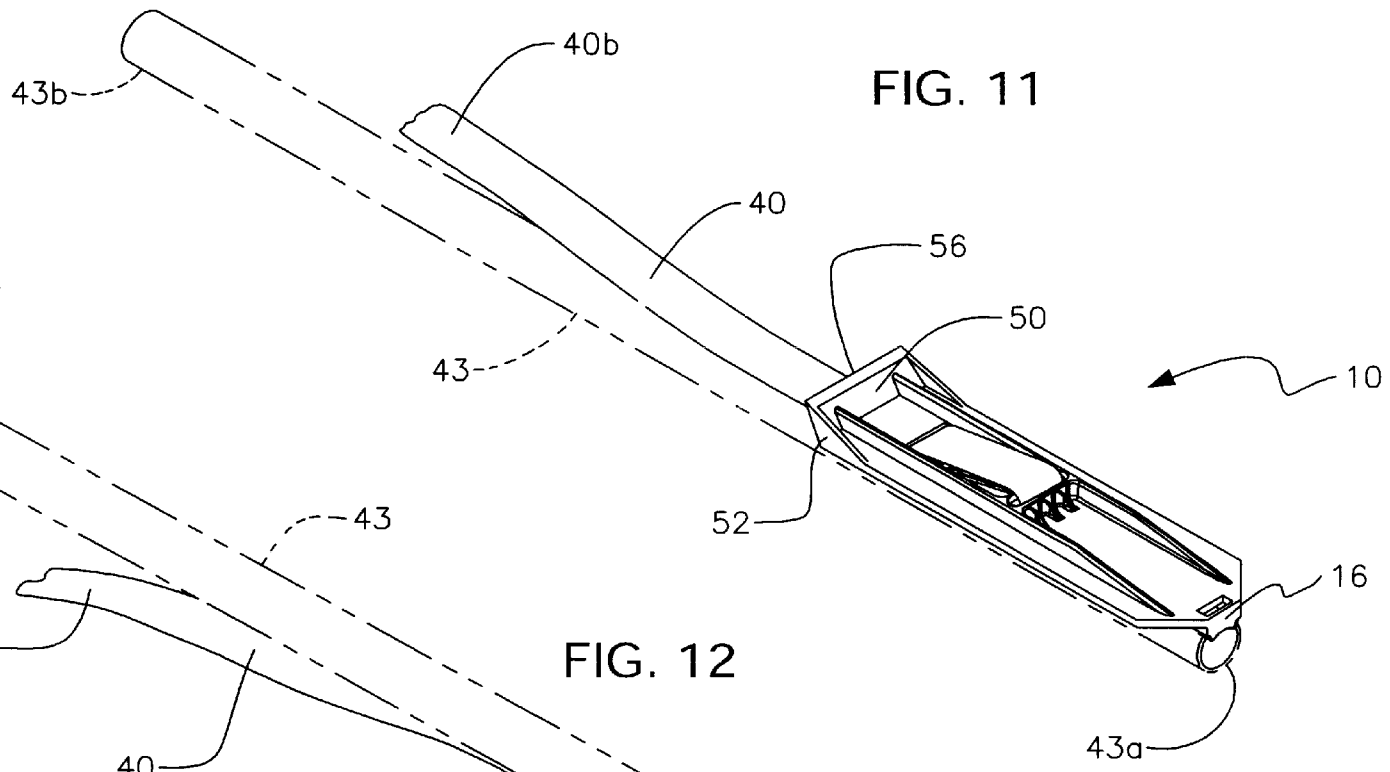
FIG. 11 is a perspective like FIG. 5 but depicting the second embodiment of the elongate base.
FIG. 12 is a perspective view like FIG. 8, but depicting the second embodiment of the elongate base.

The above-described embodiments work well in dry soil but it has been found that the pivoting about trailing edge 20 is less than optimal if the soil is wet. The embodiment depicted in FIGS. 9 and 10 works well in dry and wet soils and is therefore the preferred embodiment of the invention. Flange 50 is formed integrally with trailing edge 20 of the first-described embodiment-and projects at a forty five degree (45°) angle from the plane of elongate base 12, toward the bottom side thereof so that it does not interfere with jet pipe 43 as best understood in connection with FIGS. 11 and 12. It is supported at its opposite ends by side flanges 52, 54. Even when the soil is soaked, trailing edge 56 of flange 50 digs into the sidewall of the borehole and causes elongate base 12 to pivot into a substantially horizontal position when anchor strap 40 is pulled upon.

The novel method for installing the novel earth anchor, to be known commercially as the Terra Toggle™, at a preselected depth below the surface of the earth is the same whether the embodiment includes trailing end 20 or trailing flange 50 formed integrally with said trailing end 20. Specifically the novel method includes the steps of providing a thin, elongate base having a longitudinal axis of symmetry, a transversely disposed leading end and a transversely disposed trailing end. A nozzle attachment means is positioned at the leading end of the elongate base and disposed normal to a plane of the elongate base. An elongate anchor means is secured to the elongate base.

The nozzle attachment means is adapted to releasably engage a leading end of an elongate jet pipe means, the elongate jet pipe means being positioned substantially parallel to the elongate base when the leading end of the elongate jet pipe means is releasably engaged to the nozzle attachment means.

The elongate anchor means is dimensioned to have a length sufficient to extend from a preselected depth below the surface of the earth to a preselected height above the surface of the earth when the earth anchor is positioned at a preselected distance below the surface of the earth.

A liquid fluid under pressure is introduced into a trailing end of the jet pipe means and the elongate base is inserted into the earth by positioning the elongate base in substantially normal relation to the surface of the earth with its leading edge in abutting relation to the surface. Tension is applied to the elongate anchor means while applying pressure to the trailing end of said jet pipe means while said liquid fluid is flowing from the leading end of the jet pipe means, forming a borehole in the earth. The flow of liquid fluid is turned off, the tension on the elongate anchor means is released, and the jet pipe means is retracted from the earth when the earth anchor has reached a preselected depth.

The proximal end of the anchor strap is then pulled upon again. Such tension applied to the elongate anchor means causes the pivoting of the earth anchor about the trailing end and the earth anchor deploys into a substantially horizontal position where it is substantially perpendicular to the borehole.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. An earth anchor, comprising:

a thin, elongate base having a longitudinal axis of symmetry, a transversely disposed leading end and a transversely disposed trailing end;

an elongate anchor means having a distal end secured to said elongate base, said distal end positioned below the surface of the earth when the earth anchor is inserted into the earth and said elongate anchor means having a proximal end positioned above the surface of the earth when the earth anchor is inserted into the earth;

a nozzle attachment means positioned at said leading end of said elongate base;

said nozzle attachment means being disposed normal to a plane of said elongate base;

said nozzle attachment means adapted to releasably engage a leading end of an elongate jet pipe means;

said elongate jet pipe means adapted to, be positioned substantially parallel to said elongate base when said leading end of said elongate jet pipe means is releasably engaged to said nozzle attachment means;

means for introducing a liquid fluid under pressure into a trailing end of said elongate jet pipe means;

whereby said elongate base is inserted into the earth by first positioning said elongate base in substantially normal relation to the surface of the earth with its leading edge in abutting relation to said surface;

whereby liquid fluid under pressure is introduced into said trailing end of said elongate jet pipe means and flows from said leading end of said elongate jet pipe means to form a borehole in the earth;

whereby tension is applied to said elongate anchor means while downward pressure is applied to said trailing end of said elongate jet pipe means while said liquid fluid is flowing from said leading end of said elongate jet pipe means until said earth anchor reaches a predetermined depth;

whereby said elongate jet pipe means is withdrawn from the earth when said earth anchor reaches said predetermined depth;

whereby said proximal end of said elongate anchor means is pulled upon after said elongate jet pipe means is withdrawn; and whereby said earth anchor rotates about said trailing end when said proximal end of said elongate anchor means is pulled upon until said earth anchor deploys into a position where it is substantially perpendicular to said borehole;

whereby said earth anchor presents substantial resistance to displacement from said preselected depth when so deployed so that preselected items may be tied to said proximal end of said elongate anchor means to secure said preselected items to the surface of the earth.

2. The earth anchor of claim 1, further comprising:

a first transversely disposed slot formed in said elongate base about mid-length thereof, said first transversely disposed slot extending completely through said elongate base;

second and third transversely disposed slots formed in said elongate base between said trailing end and said first transversely disposed slot, said second and third transversely disposed slots extending completely through said elongate base and said second and third slots being longitudinally spaced apart from one another and from said first transversely disposed slot;

said first, second, and third transversely disposed slots being adapted to sequentially receive said distal end of said elongate anchor means therethrough;

said anchor means following a path of travel that extends from a first side of said earth anchor in a first direction through said first transversely disposed slot, from a second side of said earth anchor in a second direction through said third transversely disposed slot, from said first side of said earth anchor in said first direction through said second transversely disposed slot, and from said second side of said earth anchor in said second direction through said first transversely disposed slot, said distal end of said anchor means being secured to said elongate anchor means at said first side thereof.

3. The earth anchor of claim 1, further comprising a pair of parallel, longitudinally extending strengthening ribs formed integrally with said first side of said elongate base in upstanding relation thereto, each of said strengthening ribs having a leading end positioned near a leading end of said elongate base and each of said strengthening ribs having a trailing end positioned near a trailing end of said elongate base.

4. The earth anchor of claim 3, wherein each of said strengthening ribs has a leading part, a medial part, and a trailing part, and wherein the leading part of each strengthening rib is beveled to gradually reduce a height extent thereof to facilitate introduction of said elongate base into the earth.

5. The earth anchor of claim 1, further comprising a pair of parallel, longitudinally extending strengthening ribs formed integrally with said second side of said elongate base in upstanding relation thereto, each of said strengthening ribs having a leading end positioned near a leading end of said elongate base and each of said strengthening ribs having a trailing end positioned near a trailing end of said elongate base.

6. The earth anchor of claim 5, wherein each of said strengthening ribs has a leading part, a medial part, and a trailing part, and wherein the leading part of each strengthening rib is beveled to reduce a height extent thereof to facilitate introduction of said elongate base into the earth.

7. The earth anchor of claim 1, wherein said trailing end is chamfered so that said trailing end is better able to dig into the earth to facilitate rotation of said earth anchor into said perpendicular position when the proximal end of said elongate anchor means is pulled upon.

8. The earth anchor of claim 1, wherein said leading end of said elongate base is swept back to facilitate its introduction into the earth.

9. The earth anchor of claim 1, further comprising:

a flange secured to said trailing end, said flange being disposed at an approximately forty-five degree angle relative to a plane of said elongate base;

whereby said earth anchor pivots about a trailing edge of said flange when said elongate anchor means is pulled upon to position said elongate base in said substantially perpendicular relation to said borehole.

10. The earth anchor of claim 9, further comprising:

a pair of longitudinally-extending support flanges secured to opposite ends of said flange, each of said longitudinally-extending support flanges interconnecting an end of said flange to a side of said elongate base.

11. An earth anchor, comprising:

a thin, elongate base having a longitudinal axis of symmetry, a transversely disposed leading end and a transversely disposed trailing end;

an elongate anchor means having a distal end secured to said elongate base, said distal end positioned below the surface of the earth when the earth anchor is inserted into the earth and said elongate anchor means having a proximal end positioned above the surface of the earth;

a living hinge having a trailing end secured to said leading end of said elongate base;

a nozzle attachment means secured to a leading end of said living hinge; said nozzle attachment means being disposed normal to a common plane of said elongate base and said living hinge when said living hinge is in repose;

said nozzle attachment means including a centrally apertured base extension, a first part adapted to releasably engage a leading end of an elongate jet pipe means, and a nozzle part in open fluid communication with said central aperture;

said elongate jet pipe means adapted to be positioned substantially parallel to said elongate base when said leading end of said elongate jet pipe means is releasably engaged to said first part of said nozzle attachment means, said living hinge being positioned normal to a plane of said elongate base when said jet pipe means is positioned in parallel relation to said elongate base;

means for injecting a liquid fluid under pressure into a trailing end of said jet pipe means;

whereby said elongate base is inserted into the earth by first positioning said elongate base in substantially normal relation to the surface of the earth with its leading edge in abutting relation to said surface;

whereby liquid fluid under pressure is introduced into said trailing end of said jet pipe means;

whereby tension is applied to said elongate anchor means while pressure is applied to said trailing end of said jet pipe means while said liquid fluid is flowing from said leading end of said jet pipe means to form a borehole in the soil;

whereby said jet pipe means is retracted from the earth when the elongate base has reached a preselected depth;

whereby said proximal end of said elongate anchor means is pulled upon when said earth anchor reaches said preselected depth; and whereby said earth anchor rotates about said trailing end when said proximal end of said elongate anchor means is pulled upon until said earth anchor deploys into a substantially horizontal position where it is substantially perpendicular to said borehole;

whereby said earth anchor presents substantial resistance to displacement from said preselected depth when so deployed so that preselected items may be tied to said proximal end of said elongate anchor means to secure said preselected items to the surface of the earth.

12. The earth anchor of claim 11, further comprising:

a first transversely disposed slot formed in said elongate base about mid-length thereof, said first transversely disposed slot extending completely through said elongate base;

a second and a third transversely disposed slot formed in said elongate base between said trailing end and said first transversely disposed slot, said second and third transversely disposed slots extending completely through said elongate base and said second and third slots being longitudinally spaced apart from one another and from said first transversely disposed slot;

said first and second transversely disposed slots being adapted to sequentially receive said distal end of said elongate anchor means therethrough;

said elongate anchor means following a path of travel that extends from a first side of said earth anchor in a first direction through said first transversely disposed slot, from a second side of said earth anchor in a second direction through said third transversely disposed slot, from said first side of said earth anchor in said first direction through said second transversely disposed slot, and from said second side of said earth anchor in said second direction through said first transversely disposed slot, said distal end of said anchor means being secured to said anchor means at said first side thereof.

13. The earth anchor of claim 11, further comprising a pair of parallel, longitudinally extending strengthening ribs formed integrally with said first side of said elongate base in upstanding relation thereto, each of said strengthening ribs having a leading end positioned near a leading end of said elongate base and each of said strengthening ribs having a trailing end positioned near a trailing end of said elongate base.

14. The earth anchor of claim 13, wherein each of said strengthening ribs has a medial part, a leading part, and a trailing part, and wherein the leading part of each strengthening rib is beveled to reduce a height extent thereof to facilitate introduction of said elongate base into the earth.

15. The earth anchor of claim 11, further comprising a pair of parallel, longitudinally extending strengthening ribs formed integrally with said second side of said elongate base in upstanding relation thereto, each of said strengthening ribs having a leading end positioned near a leading end of said elongate base and each of said strengthening ribs having a trailing end positioned near a trailing end of said elongate base.

16. The earth anchor of claim 15, wherein each of said strengthening ribs has a medial part, a leading part, and a trailing part, and wherein the leading part of each strengthening rib is beveled to reduce a height extent thereof to facilitate introduction of said elongate base into the earth.

17. The earth anchor of claim 11, wherein said trailing end is chamfered so that said trailing end is better able to dig into the earth to facilitate rotation of said earth anchor into said perpendicular position when the proximal end of said elongate anchor means is pulled upon.

18. The earth anchor of claim 11, wherein said leading end of said elongate base is swept back to facilitate its introduction into the earth.

19. The earth anchor of claim 11, further comprising:

a flange secured to said trailing end, said flange being disposed at an approximately forty-five degree angle relative to a plane of said elongate base; whereby said earth anchor pivots about a trailing edge of said flange when said elongate anchor means is pulled upon to position said elongate base in said substantially perpendicular relation to said borehole.

20. The earth anchor of claim 19, further comprising:

a pair of longitudinally-extending support flanges secured to opposite ends of said flange, each of said longitudinally-extending support flanges interconnecting an end of said flange to a side of said elongate base.

21. A method for installing an earth anchor at a preselected depth below the surface of the earth, comprising the steps of:

providing a thin, elongate base having a longitudinal axis of symmetry, a transversely disposed leading end and a transversely disposed trailing end;

providing a nozzle attachment means positioned at said leading end of said elongate base;

disposing said nozzle attachment means normal to a plane of said elongate base;

securing an elongate anchor means to said elongate base;

adapting said nozzle attachment means to releasably engage a leading end of an elongate jet pipe means;

positioning said elongate jet pipe means substantially parallel to said elongate base when said leading end of said elongate jet pipe means is releasably engaged to said nozzle attachment means;

dimensioning said elongate anchor means to have a length sufficient to extend from a preselected depth below the surface of the earth to a preselected height above the surface of the earth;

injecting a liquid fluid under pressure into a trailing end of said jet pipe means;

inserting said elongate flat base into the earth by positioning said elongate base in substantially normal relation to the surface of the earth with its leading edge in abutting relation to said surface, by introducing liquid fluid under pressure into said trailing end of said jet pipe means, applying tension to said elongate anchor means while applying pressure to said trailing end of said jet pipe means while said liquid fluid is flowing from said leading end of said jet pipe means to form a borehole in the earth, withdrawing said jet pipe means when said earth anchor has reached a preselected depth, pulling upon said proximal end of said anchor strap, and rotating said earth anchor about said trailing end when said proximal end of said earth strap is pulled upon until said earth anchor deploys into a substantially horizontal position where it is substantially perpendicular to said borehole;

whereby said earth anchor presents substantial resistance to displacement from said preselected depth when so deployed so that preselected items may be tied to said proximal end of said elongate anchor means to secure said preselected items to the surface of the earth.

* * * * *